US006563054B1

(12) United States Patent
Damien et al.

(10) Patent No.: US 6,563,054 B1
(45) Date of Patent: May 13, 2003

(54) COMPOSITE CABLE WITH A SYNTHETIC CORE FOR LIFTING OR TRACTION

(75) Inventors: Jean-Pierre Damien, deceased, late of Saint-Denis-les Bourg (FR), by Mayse Damien, legal representative; Patrick Laboure, Meylan (FR)

(73) Assignee: Trefileurope, Bresse (FR)

( * ) Notice: Subject to any disclaimer, the term of this patent is extended or adjusted under 35 U.S.C. 154(b) by 0 days.

(21) Appl. No.: 09/787,692

(22) PCT Filed: Sep. 10, 1999

(86) PCT No.: PCT/FR99/02152

§ 371 (c)(1),
(2), (4) Date: May 17, 2001

(87) PCT Pub. No.: WO00/17441

PCT Pub. Date: Mar. 30, 2000

(30) Foreign Application Priority Data

Sep. 23, 1998 (FR) ..... 98 11982

(51) Int. Cl.[7] ..... H01B 7/00
(52) U.S. Cl. ..... 174/120 C; 174/121 R
(58) Field of Search ..... 174/102 R, 102 C, 174/102 E, 103, 106 R, 108, 110 R, 110 N, 113 R, 119 R, 120 R, 121 R, 122 R, 126.1, 126.2, 128.1, 128.2; 57/212, 214, 215, 216, 217, 218, 220

(56) References Cited

U.S. PATENT DOCUMENTS

| | | | | | |
|---|---|---|---|---|---|
| 3,075,344 | A | * | 1/1963 | Fenner et al. | 57/12 |
| 3,647,939 | A | * | 3/1972 | Schoerner | 174/128.1 |
| 3,710,006 | A | * | 1/1973 | Davis | 174/101.5 |
| 3,729,921 | A | * | 5/1973 | Stroh | 57/214 |
| 4,034,547 | A | * | 7/1977 | Loos | 57/211 |
| 4,534,163 | A | * | 8/1985 | Schuerch | 57/233 |
| 5,229,851 | A | * | 7/1993 | Rahman | 385/112 |
| 5,269,128 | A | * | 12/1993 | Walton et al. | 57/210 |
| 5,566,786 | A | * | 10/1996 | De Angelis et al. | 187/266 |
| 5,651,245 | A | * | 7/1997 | Damien | 57/214 |
| 5,727,357 | A | * | 3/1998 | Arumugasaamy et al. | 428/377 |
| 5,797,254 | A | * | 8/1998 | Walton | 57/216 |
| 5,834,942 | A | * | 11/1998 | De Angelis | 187/226 |
| 6,314,711 | B1 | * | 11/2001 | De Angelis | 57/210 |
| 6,321,520 | B1 | * | 11/2001 | De Angelis | 57/211 |
| 6,397,574 | B1 | * | 6/2002 | De Angelis | 187/266 |

FOREIGN PATENT DOCUMENTS

| | | | | |
|---|---|---|---|---|
| FR | 2 707 309 | | 1/1995 | |
| GB | 2219014 | A * | 11/1989 | D07B/1/06 |
| WO | 89-11559 | | 11/1989 | |
| WO | 94/03672 | | 2/1994 | |

OTHER PUBLICATIONS

C & M Corporation, Engineering Design Guide (3rd Edition), Jan. 1992, pp. 9–13.*

* cited by examiner

*Primary Examiner*—Dean A. Reichard
*Assistant Examiner*—William H. Mayo, III
(74) *Attorney, Agent, or Firm*—Young & Thompson

(57) ABSTRACT

The invention includes a composite cable having a plurality of strands (10, 12) stranded around a composite synthetic core (5) with a concentric structure. The core (5) has a nucleus (11) formed by a bundle of parallel synthetic fibers extending along the cable longitudinal direction, and of a compact thermoplastic sheath (13) enclosing the nucleus (11) and serving as winding support for the strands.

18 Claims, 1 Drawing Sheet

COMPOSITE CABLE WITH A SYNTHETIC CORE FOR LIFTING OR TRACTION

BACKGROUND OF THE INVENTION

The present invention relates to lifting or traction cables, particularly cables for elevators, which is to say cables which support the elevator cabin and transmit to it the movement of the drive drum.

The characteristics required for these cables are particularly high flexibility, good diametric regularity ensuring regular permanent elongation, and high resistance to abrasion, because the drive is ensured by friction between the cable and the drum. For supplemental explanation of the characteristics required for such cables and the constraints they must satisfy, reference can be had for example to French patent application filed under No. 93 08648.

The type of conventional cable used for such applications is a composite cable of eight strands of steel wire wound helically on a core of natural textile of hard fibers, such as sisal. There is also known a similar cable, but whose core itself is composite, namely constituted by metallic strands and textile filler fibers.

Traction cables for elevators can also be cables with metallic strands on a metallic core, independent or not. There are also known cables with twelve external strands wound on an independent core of the Warrington type, or again cables with nine external strands on an independent metallic core which itself has nine strands.

In other lifting applications, there are also used cables comprising natural fibers of the sisal type, or synthetic (polypropylene) fibers, whose role is to form a pad inserted between the different layers of strands. It is also sought to avoid or at least limit the friction of the filaments or strands against each other, and the risks of indentation, so as to improve and maintain the flexibility of the cable, and to avoid breaking of the filaments.

There is also known, from International patent application WO 89/11 559, a cable whose central core of elastomer or polymer serves as a support for the winding of the strands and comprises for this purpose helical grooves to receive them. The core can be hollow at the center to receive reinforcing elements.

A common point of these inserts of non-metallic material is that they do not take part directly in resisting the tension in the cable, which is to say that they do not contribute directly to increasing the resistance to traction of the cable.

There are also known, for example from U.S. Pat. No. 5,566,786, cables adapted to serve as traction cables for elevators, and which are constituted solely by synthetic fibers adapted to transmit tractive force. Such a cable has in particular the advantage of a linear mass lower than steel or composite cable, of equivalent strength. It however has the drawback of requiring important modifications relative to more conventional cables as to its use and control. For example, a system of special anchoring, very complicated, is required. Moreover, the condition of a layer of the synthetic fibers cannot be monitored, as for steel cables, by electrical or electromagnetic methods. It has been provided to insert in the synthetic fibers electrically conductive carbon fibers, whose monitoring of the conductivity permits obtaining the condition of wear of the cable. But this increases the complexity of the cable, hence the cost. Moreover, these cables can also have other drawbacks, for example poor transmission by adherence between the cable and the drive drum, or increased risk of deliberate cutting by vandalism.

SUMMARY OF THE INVENTION

The present invention has for its object to solve the problem set forth above. It seeks in particular to provide a lifting or traction cable which has, for equal weight, a considerably increased resistance to rupture relative to all steel cables or to known composite cables, permitting particularly, for the same weight, increasing the useful load as well as the height of the path of the elevators, or, for an equal load, to decrease the number of strands or the diameter of the cables used.

With these objects in mind, the invention has for its object a composite cable comprising a plurality of strands wound about a core of synthetic material, characterized in that the core is constituted by a nucleus formed by a bundle of parallel synthetic fibers extending in the longitudinal direction of the cable, and by a compact sheath of thermoplastic material enclosing said nucleus and serving as a winding support for the strands.

The principle of the invention being equally applicable to a cable in its more simple construction, which is to say a single strand, the invention also has for its object a composite strand comprising a plurality of external filaments would about a core of synthetic material, this strand being characterized in that the core is constituted by a nucleus formed by a bundle of parallel synthetic fibers extending in the longitudinal direction of the strand, and by a sheath of thermoplastic material enclosing said nucleus and serving as a winding support for the filaments.

As will be understood, the invention resides in its essential characteristics, in the presence of a composite synthetic core with two components disposed concentrically: a compact sheath which is deformable by radial compression (or thermoplastic) which tightly surrounds a central nucleus formed by a bundle of individual fibers, also of synthetic material, substantially continuous throughout the length of the cable, and arranged so as to take part effectively in any tractive force exerted on the cable by a load.

In contrast thereto, in known composite cables, the synthetic material serves as padding, to ensure holding the strands or filaments relative to each other across the section of the cable, and thus to avoid for example friction of the metallic filaments on each other or even indentations arising from radial pressure which can be exerted between the filaments or strands when the cable is tensioned, but it gives practically no supplemental contribution to tractive strength.

To participate effectively in the tractive strength, the cross section and the number of fibers of the cable or strand according to the invention are determined such that the core forms with the filaments or metallic strands an assembly such that the deformation under load, principally an elongation, is substantially equivalent for the core of synthetic fibers and for the external metallic strands or filaments, despite the differences in the mechanical characteristics of these materials. Moreover, the sheath surrounding the fibers is of a deformable but hardly compressible material, such that this material flows during production of the cable or of the strand to fill the free spaces between the core and the strands or filaments of the layer directly surrounding the core. There results therefrom a radial pressure exerted by the external strands or filaments on the sheath, and resultingly on the peripheral layer of the fibers of the core, which creates a strong adherence, or sort of mechanical cohesion, between the filaments or strands and said fibers, which ensures transmission between them of tractive forces. Moreover, the friction between the fibers, which is further increased by the radial compressive effect exerted by the external strands or filaments, permits transmitting at least in part, progressively to the center of the core, the traction forces to which the peripheral layer is subject, such that all the cross section of the core can take part in absorbing the tractive load to which the cable is subjected.

The sheath serves particularly to maintain the parallel fibers together, by ensuring the compactness of the core.

It will be noted that the transmission of forces between the external strands or filaments and the core, is further ensured by friction between the sheath and said external strands or filaments to the extent these penetrate into the material of the sheath, because this increases the contact surface.

Moreover, the sheath constitutes an intermediate layer between the external strands or filaments and the core fibers, which avoids or at least limits the shearing effect on the fibers, which extend in the axial direction, by the external filaments, or the external filaments of the strands, which are transverse to said axial direction.

As to the cable or the simple strand, the fibers are preferably of polyethylene or aramide and the sheath is for example of extruded polyamide.

The external strands of the cable according to the invention can be entirely metallic, which is to say entirely constituted by metallic filaments, or composite, and in particular constituted by composite strands themselves corresponding to the invention.

Other characteristics and advantages will become apparent from the description which will be given, of strands and cables according to the invention.

BRIEF DESCRIPTION OF THE DRAWINGS

Referring now to the accompanying drawings, in which.

DESCRIPTION OF THE PREFERRED EMBODIMENTS

Figure 1:
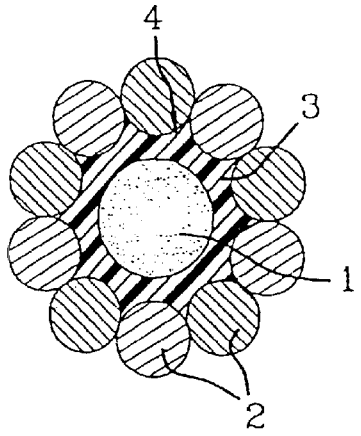
FIG. 1 is a cross section of a composite strand according to the invention.

The strand shown in cross section in FIG. 1 comprises a composite synthetic core 4 with a concentric structure: a central nucleus 1 formed by a bundle of free parallel fibers, whose cohesion is ensured by a monolithic sheath 3 which constricts the bundle. This core is surrounded by a layer of steel filaments 2 (here ten in number) wound in spiral on the sheath 3, and which compresses it about the nucleus 1 thereby giving it their impressions, as seen in the drawing.

The fibers 1 that constitute the core are for example fibers of polyethylene, aramide, Kevlar®, Twaron®, etc. The sheath 3 is of a thermoplastic material, for example polyamide, having good properties of adherence to the fibers of the core.

Figure 2:
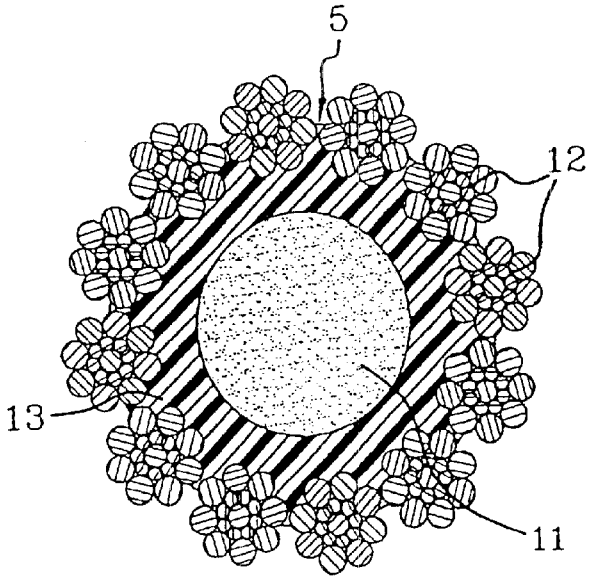
FIG. 2 is a cross section of a cable according to the invention in a first embodiment.

The cable shown in cross section in FIG. 2 is comprised by a core 5 of synthetic fibers analogous to the core 4 described above, and surrounded by twelve strands of seventeen steel filaments. Between the nucleus 11 and the external layer of strands 12, is interposed an intermediate layer of thermoplastic material, constituting a compact sheath 13 which is pressed about the core by the strands 12. As is seen in the drawing, the filaments of the strands, located inwardly of the cable, are encrusted into the thermoplastic material of the sheath 13, thereby providing a large surface contact and hence a strong adherence. This latter is further reinforced by the radial centripetal compressive force exerted by the strands on the sheath when tension is imposed on the cable.

The constituent materials of the core 5, the nucleus 11 and the sheath 13 are of the same type as those indicated for the strand of FIG. 1.

Figure 3:
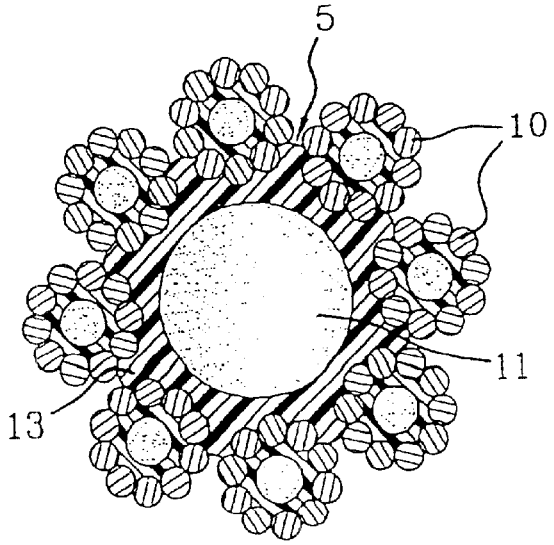
FIG. 3 is a cross section of a cable according to the invention in a second embodiment.

FIG. 3 further shows another cable, comprising a core of synthetic fibers 5 provided with a central bundle 11 of synthetic fibers and a sheath of thermoplastic material 13. Differing from the preceding embodiment, the eight strands 10 are not entirely of steel, but are in fact strands according to that shown in FIG. 1.

The three above examples are in no way limiting.

The rupture load of a conventional cable, even composite, is essentially dependent on the metallic cross section, which is the sum of all the cross sections of the filaments comprising the cable. It depends almost not at all on non-metallic inserts existing in composite cables, and in particular on the synthetic fibers which, having principally the function only of filling the voids between filaments or strands, support no part of the load.

On the other hand, the weight of the cables is due in the first instance to the weight of the steel filaments comprising it. Thus, the ratio of rupture load/weight of steel cables is substantially constant, depending principally only on the construction of the cable and not on its diameter.

The comparative table below indicates the ratio R/P of the rupture load R, to the weight per meter P, for two types of cables, 8×19 and 12×17, in a current embodiment (column 2) and made according to the invention (column 3) respectively.

| | R/P (kN/kg) | |
|---|---|---|
| Type of cable | Current cable with a sisal core. | Cable of the invention with a composite fiber core. |
| 8 × 19 | 142 | 200 |
| 12 × 17 | 146 | 260 |

The increase of the ratio R/P with a corresponding cable construction will be easily seen. Relative to all-steel cables, and to an equal weight of cable, the useful load can be increased, or conversely, for a same load, the weight and the diameter of the cables can be decreased, permitting decreasing the dimensions of the machines or framework of the elevators or like apparatus. Similarly, the lifetime of the cables according to the invention is increased relative to all-steel cables.

Relative to the cables entirely of fibers, the use of the cables according to the invention does not require any modification of the existing installations: the anchoring and the terminals of the cables are identical to the conventional applications of steel cables; the interface between the drums of the machinery and the cable is always in steel contact on the material of the drum, which does not modify the conditions of transmission of movement by adherence; the criteria of installation and replacement are the same, based on the decrease of diameter and the number of broken steel filaments; and the cables of the invention are no more subject to acts of vandalism than are all-steel cables.

The invention is not limited to the embodiments which have been described above solely by way of example. The number of filaments of each strand, and the number of strands of the cable, could obviously be modified. Similarly, the use of these cables is not limited to their application as elevator cables, and they can also be used as lifting cables, suspension cables, for use in mountains or in the maritime field, etc.

What is claimed is:

1. A composite cable comprising:

a bundle of plural parallel synthetic fibers extending in a longitudinal direction of the cable forming a core of the cable;

a deformable sleeve surrounding said core and being a thermoplastic material; and plural strands wound about and embedded in said sleeve.

2. The cable of claim 1, wherein said synthetic fibers comprise at least one of a polyethylene and an aramide.

3. The cable of claim 1, wherein said sleeve comprises a polyamide.

4. The cable of claim 1, wherein said plural strands are metal filaments.

5. The cable of claim 1, wherein each of said plural strands comprises a bundle of plural parallel synthetic fibers extending in a longitudinal direction of a strand forming a core of the strand, a sheath enclosing said core of the strand and being a thermoplastic material, and plural filaments wound about and embedded in said sheath.

6. The cable of claim 1, wherein said plural strands exert a radially inward force on said core through said sleeve so that a longitudinal deformation of said core is substantially equivalent to a longitudinal deformation of said plural strands when the cable is lifting a load.

7. The cable of claim 1, wherein said plural strands exert a radially inward force on said sleeve so that said sleeve deformably fills spaces between adjacent ones of said plural strands.

8. A composite strand comprising:

a bundle of plural parallel synthetic fibers extending in a longitudinal direction of the strand forming a core of the strand;

a deformable sheath enclosing said core and being a thermoplastic material; and plural filaments wound about and embedded in said sheath.

9. The composite strand of claim 8, wherein said synthetic fibers comprise at least one of a polyethylene and an aramide.

10. The composite strand of claim 8, wherein said sheath comprises a polyamide.

11. The composite strand of claim 8, wherein said plural filaments are metal.

12. The composite strand of claim 8, wherein said plural filaments exert a radially inward force on said core through said sheath so that a longitudinal deformation of said core is substantially equivalent to a longitudinal deformation of said plural filaments when the cable is lifting a load.

13. The composite strand of claim 8, wherein said plural filaments exert a radially inward force on said sheath so that said sheath deformably fills spaces between adjacent ones of said plural filaments.

14. A composite cable for lifting a load, comprising:

a bundle of plural parallel synthetic fibers extending in a longitudinal direction of the cable forming a core of the cable;

a sheath of thermoplastic material surrounding said core; and plural strands wound on said sheath and exerting a radially inward force on said sheath so that said sheath deformably fills spaces between adjacent ones of said plural strands, and wherein said sheath exerts a radially inward force on said plural synthetic fibers so that a longitudinal deformation of said core is substantially equivalent to a longitudinal deformation of said plural strands when the cable is lifting a load.

15. The cable of claim 14, wherein said synthetic fibers comprise at least one of a polyethylene and an aramide.

16. The cable of claim 14, wherein said sheath comprises a polyamide.

17. The cable of claim 14, wherein said plural strands are metal filaments.

18. The cable of claim 14, wherein each of said plural strands comprises a bundle of plural parallel synthetic fibers extending in a longitudinal direction of a strand forming a core of the strand, a sleeve enclosing said core of the strand and being a thermoplastic material, and plural filaments wound about and embedded in said sleeve, and wherein said sheath deformably fills spaces between adjacent ones of said plural filaments.

* * * * *